United States Patent [19]

Thompson

[11] Patent Number: 4,706,421

[45] Date of Patent: Nov. 17, 1987

[54] GABLE RAKE STRIP FOR A TILE ROOF

[75] Inventor: Roger D. Thompson, La Canada, Calif.

[73] Assignee: Boral (USA) Inc., Los Angeles, Calif.

[21] Appl. No.: 339,086

[22] Filed: Jan. 13, 1982

[51] Int. Cl.[4] ..... E04D 1/36; E04D 13/00

[52] U.S. Cl. ..... 52/94; 52/95; 52/58

[58] Field of Search ..... 52/94, 96, 95, 58, 59

[56] References Cited

U.S. PATENT DOCUMENTS

| | | | |
|---|---|---|---|
| 397,534 | 2/1889 | Carroll | 52/96 |
| 1,090,985 | 3/1914 | Hopkins | 52/96 |
| 1,327,770 | 1/1920 | Norton | 52/96 |
| 1,836,657 | 12/1931 | Fosseen | 52/96 |
| 2,855,872 | 10/1958 | Tiernan | 52/96 |
| 3,137,970 | 6/1964 | Tiernan | 52/95 |
| 3,766,694 | 10/1973 | Minialoff et al. | 52/58 |
| 3,922,824 | 12/1975 | Izawa et al. | 52/94 |
| 4,160,346 | 7/1979 | Kaufmann | 52/96 |
| 4,233,786 | 11/1980 | Hildreth | 52/94 |
| 4,241,549 | 12/1980 | Hall, III et al. | 52/94 |
| 4,332,117 | 6/1982 | Quinnell | 52/94 |

FOREIGN PATENT DOCUMENTS

| | | | |
|---|---|---|---|
| 1476368 | 12/1952 | Austria | 52/58 |
| 1934927 | 12/1970 | Fed. Rep. of Germany | 52/94 |

*Primary Examiner*—William F. Pate, III
*Assistant Examiner*—Michael Safavi
*Attorney, Agent, or Firm*—Burns, Doane, Swecker & Mathis

[57] ABSTRACT

A gable rake strip is employed in tile roofs. The rake strip is disposed along the gable edges and comprises a base portion and an upstanding portion. The base portion includes a plurality of upstanding ridges disposed parallel to the gable edge. The gable edge tiles are supported upon the ridges. The inner terminal edge of the strip is coplanar with the main plane of the base portion to admit a lateral flow of water. The upper end of the upstanding portion is reversed-back to either hook over a rake trim board or to assume the appearance of such a board.

4 Claims, 5 Drawing Figures

GABLE RAKE STRIP FOR A TILE ROOF

BACKGROUND AND OBJECTS OF THE INVENTION

The present invention relates to tile roofs and, in particular, to the supporting of tiles along gable rake edges of the roof.

Tiles used in tile roofing have traditionally been laid such that their upper or head ends are directly supported by the solid sheathing or by battens placed on the sheathing in parallel relation to the eave edge of the roof, and their lower or nose ends rest upon the head end of the next lower tile. Thus, all of the tiles are coplanar. A rib-and-groove connection between adjacent tiles helps retain the tiles in position.

A rake trim board may be secured along the gable edge of the roof to cover the exposed ends of the tiles, or special rake trim tiles can be used for this purpose. Rake trim tiles impart substantial weight to a gable rake overhang and create a relatively massive appearance which may not always be desirable. Although these drawbacks can be avoided by the use of rake trim boards, a clearance typically results between the tiles and the boards which results in water entering beneath the tiles.

It has been proposed in U.S. Pat. No. 3,922,824 issued to Izawa et al on Dec. 2, 1975 to provide a gable strip which extends along the gable rake edge of the roof. The strip includes a base secured by fasteners to the roof and an upright wall extending upwardly from the gable edge of the roof. An elastic sealing member is mounted on the inside surface of the upright wall. By pushing a roofing sheet or tile firmly against the elastic member, a water-tight seal is to be created along the gable rake edge. The base portion is provided with short ridges that extend parallel to the gable edge in order to impede the inward flow of water which may leak past the roofing tile and the elastic member. Water which may travel over the ridges is blocked by a dam formed by a reversely bent inner terminal edge of the strip. While such a dam may restrict travel of the water past the strip, it results in water collecting above the fasteners which secure the base to the roof, whereby water may leak through the roof via the fasteners. In addition, the elastic member in which the roofing tile is positioned will not provide adequate support for the tile for a sufficiently long period due to its exposure to ambient conditions.

It has also been conventional to position an L-shaped strip along the gable edge whereby the base portion thereof is mounted upon the roof and the tiles are laid thereupon. However, there is no restriction to the inward flow of water and, in the event that the roof contains battens for mounting the tiles, the battens are extended across the strip base and thus can create dams which prevent the downward flow of water.

It is, therefore, an object of the present invention to minimize or obviate problems of the type described above.

A further object is to provide for water drainage along the gable edges of tile roofs while maintaining adequate support for the gable tiles.

An additional object of the invention is to provide for water drainage while minimizing the chances for water leakage.

Yet another object of the invention is to provide a cover for gable tiles which is light in weight, supports roofing tiles, provides for water drainage and resists leakage.

SUMMARY OF THE INVENTION

These objects of the invention are achieved by the present invention which involves a gable rake strip for use in a tile roof. In use of the invention, the roof is of the type comprising a sheathing, a waterproof underlayment disposed upon the sheathing, and a covering of tiles disposed atop the underlayment such that nose ends of the tiles rest upon the head ends of the next lower tiles. The rake strip is disposed along a gable edge to cover exposed ends of the tiles. The rake strip comprises a base portion supported upon the roof and an upstanding portion extending upwardly from an outer side of the base portion. The base portion includes a plurality of upstanding ridges disposed parallel to the gable edge. The gable edge tiles are supported upon the ridges. The upper end of the upstanding portion is reversed downwardly to the outside of the strip.

THE DRAWINGS

These objects and advantages of the invention will become apparent from the following detailed description of a preferred embodiment thereof, in connection with the accompanying drawings in which like numerals designate like elements, and in which.

DETAILED DESCRIPTION OF PREFERRED EMBODIMENTS OF THE INVENTION

Figure 2:
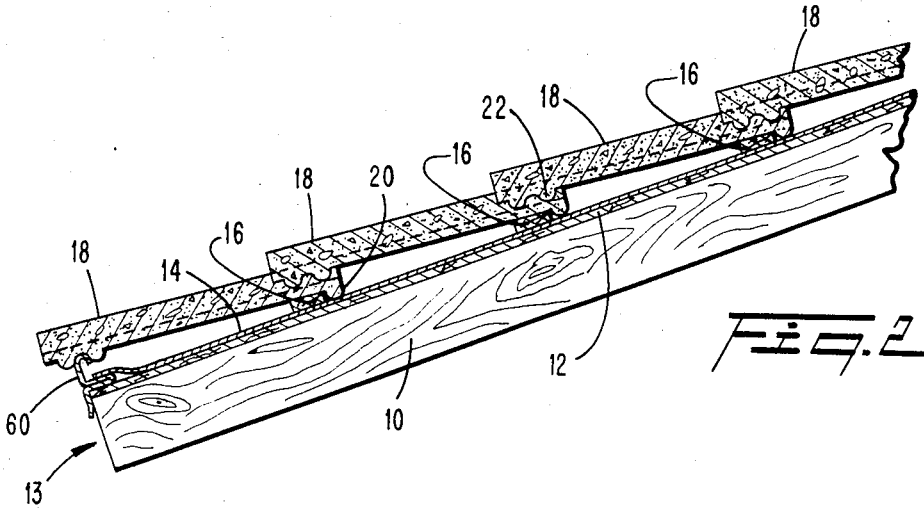
FIG. 2 is a longitudinally sectional view taken through a tile roof in a direction parallel to the gable edge of the roof, depicting the manner in which tiles are arranged.

In FIG. 2 there is depicted a cross-sectional view through a tile roof which comprises a plurality of rafters 10 extending parallel to the gable edges 11 (FIG. 3) of the roof and perpendicular to the eave course 13 of the roof. A solid wood sheathing 12 is disposed atop the rafters 10, and a waterproof underlayment 14 of a conventional felt material, for example, is secured upon the sheathing 12.

A plurality of wooden battens 16 are attached upon the underlayment and extend parallel to the eave course of the roof.

The tiles 18, which may be formed of fired clay, stone, concrete, etc., are of conventional flat design. An upper or head end of each tile includes a depending lug 20 which hooks around a rear side of a respective batten 16. A lower or nose end 22 of the next upper tile rests upon that head end.

Figure 1:
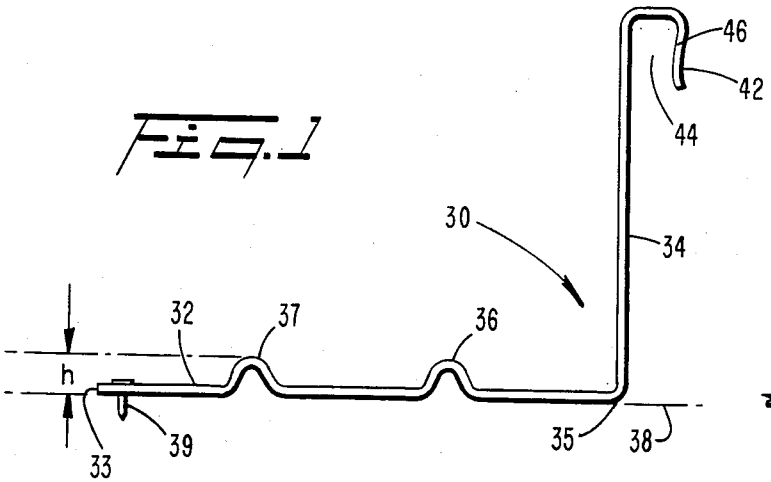
FIG. 1 is an end view of a gable rake strip according to the present invention.
Figure 3:
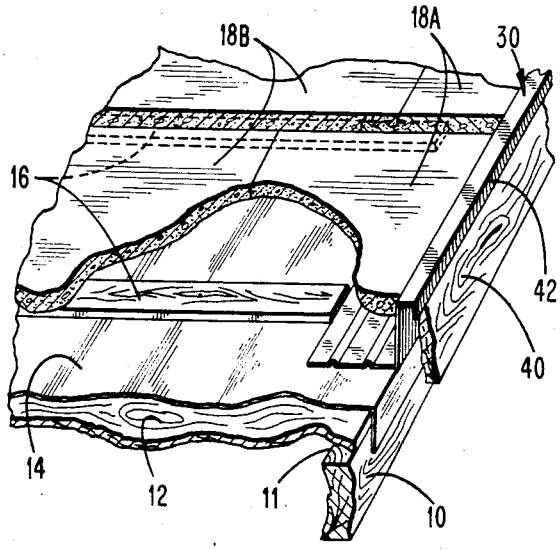
FIG. 3 is a perspective view of a tile roof, with portions of tiles broken away to expose the gable rake strip.
Figure 4:
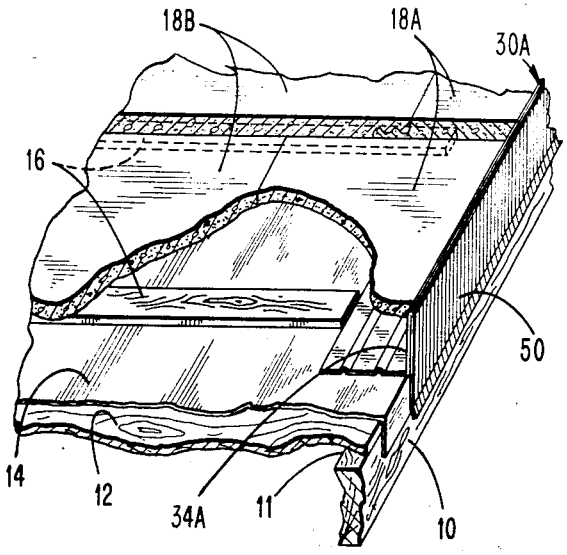
FIG. 4 is a perspective view similar to FIG. 3 depicting another form of gable rake strip according to the invention.

In accordance with the present invention, the battens 16 terminate short of the gable edges 11 and gable rake strips 30 are attached along the gable edges (FIGS. 1, 3, 4). Each rake strip 30 comprises a base portion 32 and an upstanding portion 34. The base portion 32 is positioned along a respective gable edge 11 of the roof atop the underlayment 14. Intermediate the inner and outer terminal edges 33, 35 of the base portion 32 are disposed a pair of mutually parallel ridges 36, 37 extending parallel to the upstanding portion 34 and to the gable edge 11. The ridges 36, 37 extend upwardly from a main plane 38 defined by the base portion by a distance h approximating the height of the lugs 20, namely ½ inch. Such a height resists the lateral advancement (i.e., to the left in FIG. 1) of water which may seep-in around the gable tiles. Thus, such water is confined to travel downwardly toward the eave course of the roof.

The rake strip 30 is secured to the sheathing by means of pointed fasteners, such as nails 39 (FIG. 1) which are inserted between the innermost ridge 37 and the inner terminal edge 33 of the strip.

The tiles 18A which extend immediately along the gable edges 11 of the roof are supported directly upon the ridges 36, 37. Such tiles have no depending lugs 20 so as to be substantially coplanar with the next horizontally adjacent tile 18B.

The battens terminate short of the innermost ridge 37, and preferably short of the inner terminal edge 33 of the strip 30. Moreover, the inner terminal edge 33 lies in the main plane 38 of the base portion 32, e.g., is not bent upwardly. Due to the two above-described features, any water which may happen to travel laterally over the ridges 36, 37, will drain freely off the strip, i.e., will not become dammed-up and thereby tend to leak through the roof via the nails 39.

The rake strip 30 can be employed on roofs which do not contain battens. That is, in such roofs the head lugs 20 of the non-gable tiles 18B are laid directly upon the underlayment 14, whereas no head lugs are provided on the gable tiles 18A (or are broken-off standard tiles). Thus, the ridges 36, 37 whose height h is substantially the same as that of the head lugs 20 will elevate the gable tiles to substantially the same height as the adjacent non-gable tiles 18B.

The strip 30 may be formed of any suitable corrosion resistant material, such as galvanized metal having a baked-on enamel coating. Preferably, the strip is formed of a single piece of metal which is bent to the desired configuration.

In cases where the roof has a rake trim board 40 extending along the gable edge 11, a strip 30 is employed which has a reversed section 42 that defines a downwardly open slot 44 adapted to receive the upper edge of such trim board 40, as depicted in FIG. 3.

A part 46 of the reversed section 42 extends slightly back toward the upstanding portion 34 (i.e., toward the left in FIG. 1) such that a tight-fit will occur between the slot 44 and the trim board 40 as the reversed part 42 flexes outwardly to receive the trim board.

Figure 5:
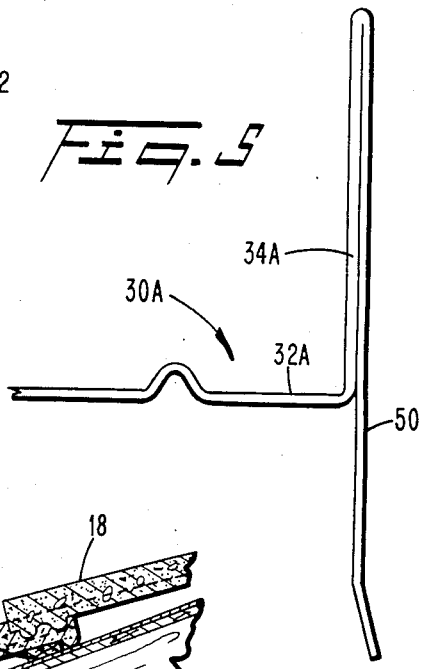
FIG. 5 is an end view of a portion of the gable rake strip depicted in FIG. 4.

In roofs having no trim board 40, a strip 30A (FIGS. 4–5) is employed which includes an outer portion 50 integral with the upstanding portion 34A and pressed thereagainst. The outer portion 50 extends below the base portion 32A so that when installed, the outer portion 50 extends below and outside of the gable edge 11 of the roof. Thus, the outer portion 50 assumes the appearance and function of a trim board 40.

The strip 30 extends downwardly along the gable edge 11 of the roof to the eave course 13. In tile roofs it is customary to position an upstanding member along the eave course to support the nose ends of the eave course tiles 18C (FIG. 2). For example, such an upstanding member may comprise a starter strip 60 described in my companion patent application Ser. No. 06/339,085, filed concurrently herewith and entitled "Starter Strip for a Tile Roof". In such a case, the ends of the vertical portion of the starter strip 60 would be cut away and the lower ends of the rake strip 30 would be extended atop and over the remaining horizontal base portion of the starter strip 60.

It will be appreciated that the present invention provides for the drainage of water which enters via the gable tiles 18A or which collects behind the gable tiles 18A or which collects behind the battens 16, while maintaining ample support for the tiles. The ridges 36, 37 are of a height sufficient to retard the lateral flow of water while supporting the tiles at a proper level. The inner terminal edge 33 of the strip 30 does not block the lateral flow of water, so that leakage through the nail holes is not promoted. The invention can accommodate tile roofs with or without a gable trim board and can prevent the ingress of water beneath the underlayment in each instance. The light-weight strip is simple and inexpensive to manufacture since it merely requires the bending of a strip of sheet metal.

Although the invention has been described in connection with preferred embodiments thereof, it will be appreciated by those skilled in the art, that additions, modifications, substitutions, and deletions not specifically described, may be made without departing from the spirit and scope of the invention as defined by the appended claims.

What is claimed is:

1. In a tile roof the type comprising a sheathing, a waterproof underlayment disposed upon the sheathing, a covering of tile disposed atop the underlayment such that nose ends of the tiles rest upon the head ends of the next lower tiles, and a rake strip disposed along a gable edge to cover exposed ends of the tiles, said rake strip comprising a base portion supported upon said roof and an upstanding portion extending upwardly from an outer side of said base portion, said base portion including a plurality of upstanding ridges disposed parallel to the gable edge, the gable tiles including head ends supported upon said ridges, the upper end of said upstanding portion being reversed downwardly to the outside of said strip, wherein tiles located adjacent said gable tiles include head ends which comprise downwardly projecting legs by which said last-named head ends are supported, said head ends of said gable tiles being free of lugs in the region where said gable tiles rest upon said ridges.

2. A tile roof according to claim 1, wherein said rake strip is anchored to said sheathing by nails extending through said base portion between an innermost one of said ridges and an inner terminal edge of said strip, the latter edge being spaced laterally from said innermost ridge, said inner terminal edge being substantially coplanar with a main plane of said base portion to permit the lateral flow of water therepast.

3. Apparatus according to claim 1, wherein said roof includes an upstanding rake trim board disposed along said gable edge, said reversed section of said upstanding portion of said rake strip defining a downwardly open channel which receives an upper end of said trim board.

4. Apparatus according to claim 1, wherein the height of said ridges is substantially ½ inch.

* * * * *